US007187375B2

(12) United States Patent
Ha et al.

(10) Patent No.: US 7,187,375 B2
(45) Date of Patent: Mar. 6, 2007

(54) APPARATUS AND METHOD OF GENERATING GAMMA VOLTAGE

(75) Inventors: Yong Min Ha, Kyoungsangbuk-do (KR); Seok Hee Jeong, Daegu (KR); Hoon Ju Chung, Kyounggi-do (KR); Dai Yun Lee, Kyounggi-do (KR); Han Sang Lee, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 319 days.

(21) Appl. No.: 10/423,018

(22) Filed: Apr. 25, 2003

(65) Prior Publication Data

US 2004/0113923 A1 Jun. 17, 2004

(30) Foreign Application Priority Data

Dec. 11, 2002 (KR) ..... 10-2002-0078835
Dec. 27, 2002 (KR) ..... 10-2002-0084875

(51) Int. Cl.
*G09G 5/00* (2006.01)

(52) U.S. Cl. ..... 345/212; 345/690

(58) Field of Classification Search ..... 345/77–84, 345/87–88, 90–100, 204, 210, 214, 690
See application file for complete search history.

(56) References Cited

U.S. PATENT DOCUMENTS 6,731,259 B2 * 5/2004 Yer et al. ..... 345/89
2002/0101416 A1 8/2002 Woo et al.
2002/0126075 A1 * 9/2002 Willis ..... 345/87
2002/0196214 A1 * 12/2002 Park et al. ..... 345/82
2003/0085905 A1 * 5/2003 Mori et al. ..... 345/589
2003/0132907 A1 * 7/2003 Lee et al. ..... 345/98

FOREIGN PATENT DOCUMENTS

| | | |
|---|---|---|
| CN | 1359098 | 7/2002 |
| JP | 2-207295 A | 8/1990 |
| JP | 6-205340 A | 7/1994 |
| WO | WO 02/073585 | 9/2002 |

* cited by examiner

*Primary Examiner*—Richard Hjerpe
*Assistant Examiner*—Mansour M. Said
(74) *Attorney, Agent, or Firm*—Morgan, Lewis & Bockius, LLP

(57) ABSTRACT

An apparatus for generating gamma voltage includes a plurality of gamma set generators and a gamma set selector. The gamma set generators generate a plurality of gamma voltage sets that include gamma voltages having different voltage levels from each other such that each gamma voltage set corresponds with a brightness mode. The gamma set selector selects any one of the gamma voltage sets in response to the brightness mode and drives data lines of a display device in accordance with the selected gamma voltage set.

15 Claims, 10 Drawing Sheets

APPARATUS AND METHOD OF GENERATING GAMMA VOLTAGE

The present application claims the benefit of Korean Patent Application No. 2002-78835 filed in Korea on Dec. 11, 2002, and Korean Patent Application No. 2002-84875 filed in Korea on Dec. 27, 2002, which are hereby incorporated by reference.

BACKGROUND OF THE INVENTION

1. Field of the Invention

The present invention relates to an apparatus that generates gamma voltage used in a display device, and more particularly, to an apparatus and method for generating gamma voltage in a display device.

2. Discussion of the Related Art

Recently, various flat display panel technologies have become more common due to reduced weight and bulk in comparison to cathode ray tube (CRT) technology. Such flat display panel technologies include liquid crystal displays, field emission displays, plasma display panels, and electroluminescence (EL) display devices. Among these, the EL display device is a self-luminous device that causes a fluorescent substance to emit light by a re-combination of an electron and a hole, and can be generally classified into an inorganic EL where an inorganic compound is used as the fluorescent substance and an organic EL where an organic compound is used. The EL display device has many advantages such as low driving voltage self-luminescence, thin profile, wide-viewing angle, rapid response speed, and high contrast. Hence, the EL device is expected to be a next generation display device.

The organic EL device generally includes an electron injection layer, an electron transport layer, a light-emitting layer, a hole transport layer, and a hole injection layer. These elements are deposited between a cathode and an anode. In such an organic EL device, when a specified voltage is applied between the anode and the cathode, an electron generated from the cathode moves to the light-emitting layer through the electron injection layer and the electron transport layer. Meanwhile, a hole generated from the anode moves to the light-emitting layer through the hole injection layer and the hole transport layer. Accordingly, the re-combination of the electron and the hole supplied from the electron transport layer and the hole transport layer causes light to be emitted in the light-emitting layer.

An active matrix EL display device using such an organic EL device, as shown in FIG. 1, includes an EL panel 20 having pixels 28 each arranged at an area defined by a scan line SL and a data line DL crossing each other, a scan driver 22 driving the scan lines SL of the EL panel 20, a data driver 24 driving the data lines DL of the EL panel 20, and a gamma voltage generator 26 applying a plurality of gamma voltages to the data driver 24. The scan driver 22 applies scan pulses to the scan lines SL to sequentially drive the scan lines SL. The data driver 24 converts a digital data signal input from the outside into an analog data signal based on the gamma voltage from the gamma voltage generator 26. The data driver 24 also applies the analog data signal to the data lines DL whenever the scan pulse is applied. Each pixel 28 receives the data signal from the data line DL to generate a light corresponding to the data signal when the scan line SL is supplied with the scan pulse.

To this end, each pixel PE, as shown in FIG. 2, includes an EL cell OEL having a cathode connected to a ground voltage source GND, and a cell driver 30 connected to the scan line SL, the data line DL, a supply voltage source VDD, and an anode of the EL cell OEL for driving the EL cell OEL. The cell driver 30 includes a switching thin film transistor T1 with a gate terminal connected to the scan line SL, a source terminal connected to the data line DL, and a drain terminal connected to a first node N1, a driving thin film transistor T2 with its gate terminal connected to the first node N1, a source terminal connected to the supply voltage source VDD, and a drain terminal connected to the EL cell OEL, and a capacitor C connected between the supply voltage source VDD and the first node N1.

The switching thin film transistor T1 is turned on to apply the data signal from the data line DL to the first node N1 if the scan line SL is supplied with the scan pulse. Having been applied to the first node N1 the data signal charges the capacitor C and, the same time, is applied to the gate terminal of the driving thin film transistor T2. The driving thin film transistor T2 controls the amount of current I applied to the EL cell OEL from the supply voltage source VDD in response to the data signal applied to the gate terminal, thereby controlling the amount of light-emission of the EL cell OEL. Because the data signal is held from the capacitor C even after the switching thin film transistor T1 is turned off, the driving thin film transistor T2 applies the current I from the supply voltage source VDD to the EL cell OEL until the data signal of the next frame is applied, thereby causing the light-emission of the EL cell OEL to be sustained.

In such a manner, the related art EL display device applies a current signal proportional to an input data to each of EL cells OEL, and the EL cells OEL emit light to display a picture. And, the EL cells OEL include an R cell OEL having a red fluorescent substance (hereinafter, R), a G cell OEL having a green fluorescent substance (hereinafter, G), and a B cell OEL having a blue fluorescent substance (hereinafter, B) to realize color. The three cells OEL R, G, B are then mixed to realize a color for a pixel.

FIG. 3 illustrates a detailed circuit configuration of the gamma voltage generator 26 shown in FIG. 1. The gamma voltage generator 26 shown in FIG. 3 generates a gamma voltage set having a number n of gamma voltages GMA1 to GMAn with different voltage values than one another corresponding to different brightness levels than one another. In the example of FIG. 3, the number n is five. To this end, the gamma voltage generator 26 has a number (n+1) of resistors R1 to Rn+1 connected in series between the supply line of the supply voltage VDD and the supply line of the ground voltage GND. The gamma voltages GMA1 to GMAn with different voltage values from one another are generated in each of voltage division points of the (n+1) number of the resistors R1 to Rn+1.

In this way, the gamma voltage generator 26 of the related art generates the gamma voltage set having the n gamma voltages GMA1 to GMAn, and the data driver 24 converts the digital data into the analog data signal based on the gamma voltage set, thereby controlling the current signal applied to the EL cell OEL. Accordingly, the gamma voltage set generated from the gamma voltage generator 26 influences the brightness of the EL display device. However, there arises a necessity for a scheme to adaptively control brightness in accordance with the brightness of an outside environment to provide a clear picture regardless of place or conditions.

SUMMARY OF THE INVENTION

Accordingly, the present invention is directed to an apparatus and method of generating gamma voltage that substantially obviates one or more of the problems due to limitations and disadvantages of the related art.

An object of the present invention is to provide an apparatus and method for generating gamma voltage to adaptively generate a gamma voltage set in accordance with a brightness of the outside.

Another object of the present invention is to provide an apparatus and method for adaptively generating gamma voltage to conserve power.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for generating gamma voltage comprises a plurality of gamma set generators to generate a plurality of gamma voltage sets that include gamma voltages having different voltage levels from each other, each gamma voltage set corresponding with a brightness mode; and a gamma set selector to select any one of the gamma voltage sets in response to the brightness mode and to drive data lines of a display device in accordance with the selected gamma voltage set.

In another aspect, an apparatus for generating gamma voltage comprises a multiplexor to selectively apply a supply voltage in response to a brightness mode; and a gamma voltage generator having a plurality of gamma voltage set generators to generate a plurality of gamma voltage sets that include gamma voltages having different voltage levels from each other such that each gamma voltage corresponds to a respective brightness mode, the gamma voltage generator generating a gamma voltage set at a corresponding gamma voltage set generator to which the supply voltage is selectively applied by the multiplexor and applying the generated gamma voltage set.

In another aspect, a method for generating gamma voltage comprises the steps of generating a plurality of gamma voltage sets including gamma voltages with different voltage levels from each other in accordance with preset brightness modes; generating a brightness mode signal in accordance with an external brightness mode; and selecting and applying one of the gamma voltage set having one of the preset brightness modes corresponding to the brightness mode signal.

In another aspect, a method for generating gamma voltage comprises the steps of selectively applying a supply voltage in response to a brightness mode signal; generating a gamma voltage set of a corresponding brightness mode at the gamma voltage set generator to which the supply voltage is applied among a plurality of gamma voltage set generators for generating a plurality of gamma voltage sets that include gamma voltages having different voltage levels from each other in accordance with the brightness mode; and applying the generated gamma voltage set.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 4:
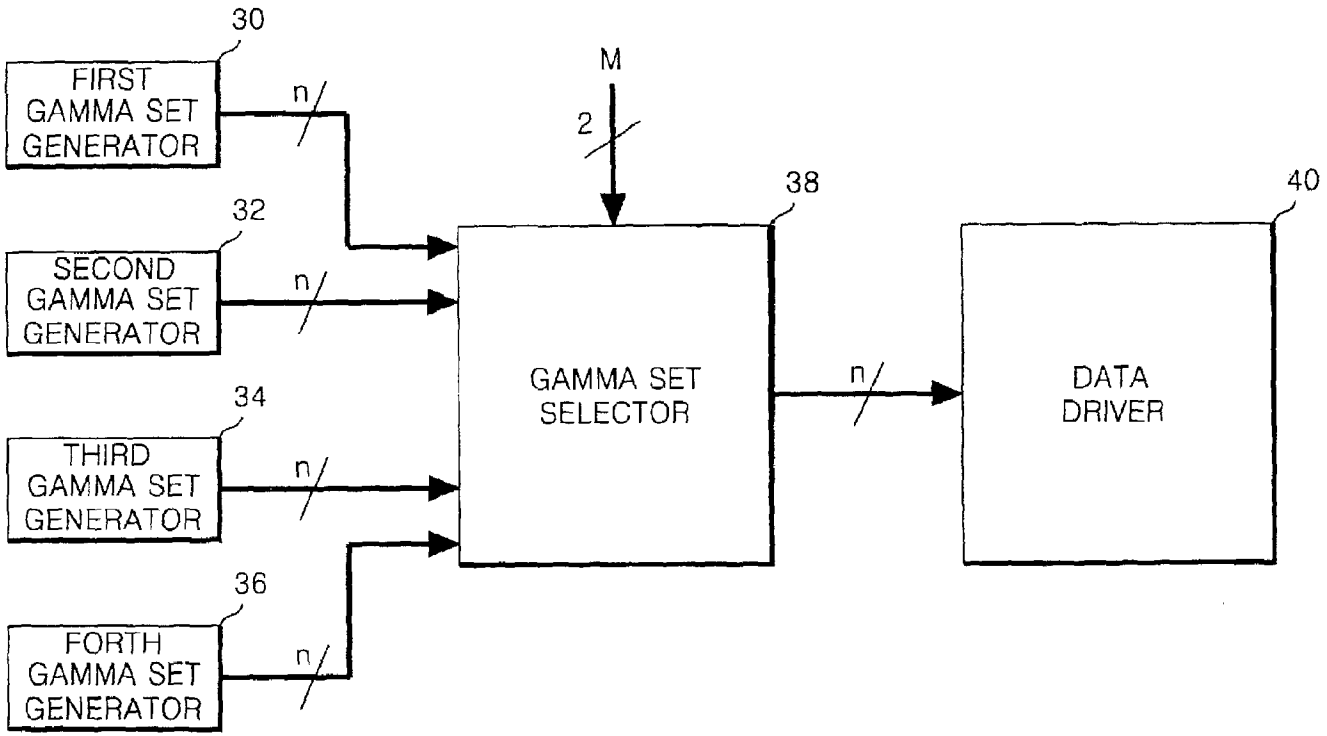
FIG. 4 is a diagram illustrating a gamma voltage generating apparatus according to a first exemplary embodiment of the present invention.

FIG. 4 illustrates a gamma voltage generating apparatus according to a first exemplary embodiment of the present invention. The gamma voltage generating apparatus shown in FIG. 4 includes a plurality of gamma set generators (e.g., gamma set generators 30, 32, 34, and 36 as shown as an example in FIG. 4) generating different gamma voltage sets than one another, and a gamma set selector 38 selecting any one gamma voltage set of the gamma voltage sets from the gamma set generators 30, 32, 34, and 36 to apply the selected gamma voltage set to a data driver 40.

The first to fourth gamma set generators 30, 32, 34, and 36) generate the first to fourth gamma voltage sets different than one another in corresponding to the brightness modes of the outside that are respectively different than one another. In this case, the first to fourth gamma voltage sets respectively generated from the first to fourth gamma set generator 30, 32, 34, and 36 correspond to brightness modes different than one another. Thus, each gamma voltage set includes gamma voltages with different voltage levels than one another. That is, the first to fourth gamma set generator 30, 32, 34, and 36 each generate gamma voltages different than one another for the different brightness level in accordance with a preset brightness mode. Herein, the gamma voltage set means gamma voltages generated by brightness levels and includes a number n gamma voltages different than one another.

Figure 1:
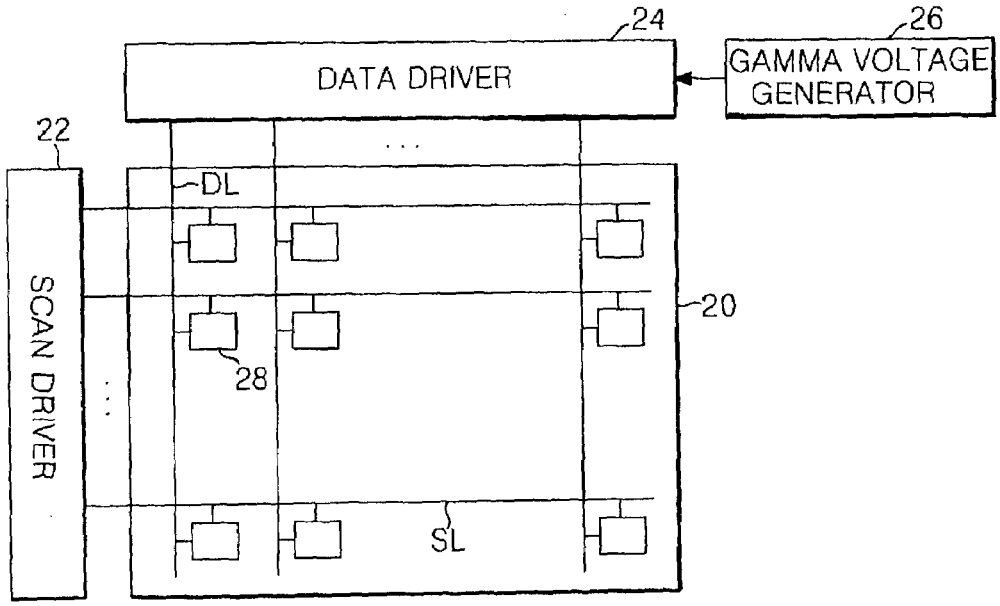
FIG. 1 RELATED ART
FIG. 1 is a diagram illustrating an organic EL display device of the related art.
Figure 2:
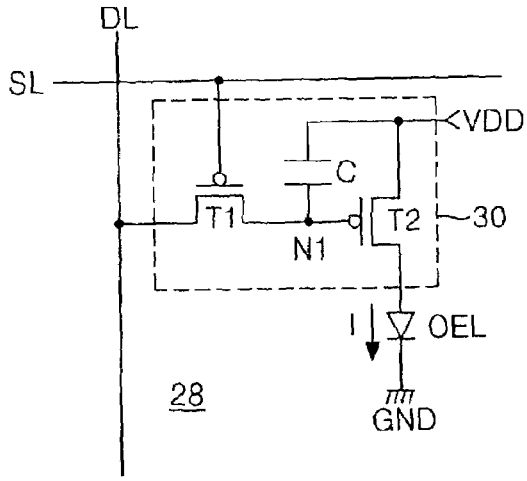
FIG. 2 RELATED ART
FIG. 2 is a diagram illustrating the configuration of a pixel shown in FIG. 1 in detail.
Figure 3:
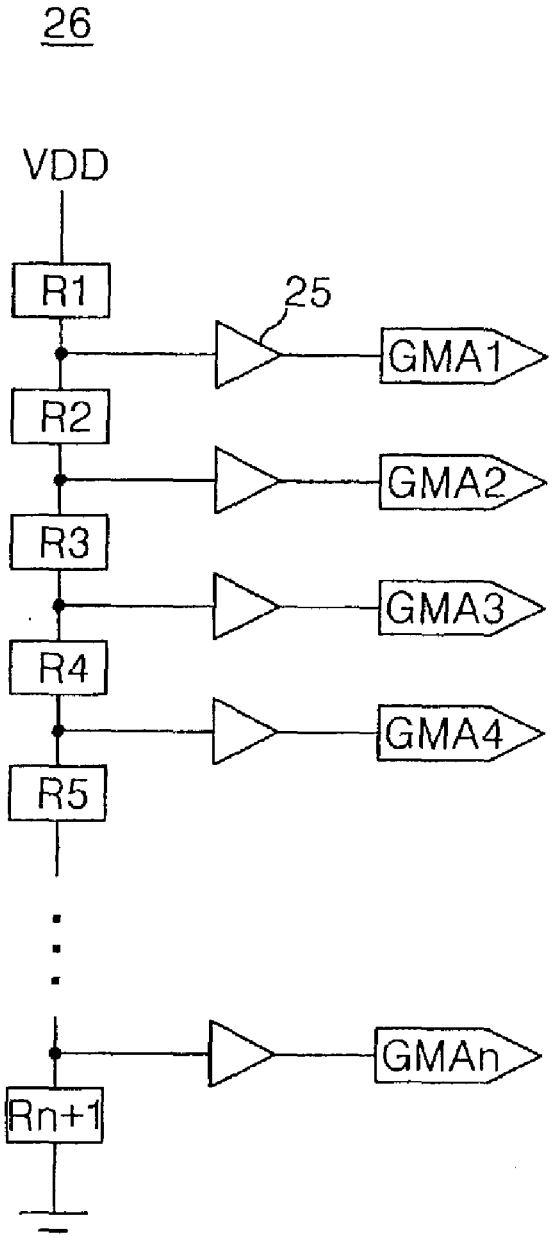
FIG.3 RELATED ART
FIG. 3 is a diagram illustrating the configuration of a gamma voltage generator shown in FIG. 1 in detail.

To this end, the first to fourth gamma set generators 30, 32, 34, and 36 each include a plurality of resistors connected in series between a supply voltage source VDD and a ground voltage source GND similar to that shown in FIG. 3. The first to fourth gamma set generators 30, 32, 34, and 36 each further include resistors with different values than one another because gamma voltage sets with different levels than one another are to be generated.

The gamma set selector 38 selects any one gamma voltage set of the first to fourth gamma voltage sets from the first to fourth gamma set generators 30, 32, 34, and 36 in response to a brightness mode signal M input from the outside to apply the selected gamma voltage set to the data driver 40. Herein, the brightness mode signal M is generated through a control block (not shown) when a user selects a brightness mode based on a brightness mode selection button provided in an EL display device or a computer system connected to the EL display device or a brightness mode selection menu displayed in the EL display panel. Further, the brightness mode signal M may be generated when the extent of the outside brightness is detected by a brightness detection sensor provided at the outside of the EL display device. In the illustrated example, such a brightness mode signal M includes two-bit data to control the brightness mode having four steps corresponding thereto in the case of there being the first to fourth gamma set generators 30, 32, 34, and 36, as shown in FIG. 4. Of course, in accordance with the present invention, the brightness mode signal can be embodied with other bit numbers. The data driver 40 converts a digital pixel data applied from a control block (not shown) into an analog pixel signal based on a gamma voltage set input through the gamma set selector 38, and applies the analog pixel signal to the data lines of an EL display panel (not shown).

Figure 5:
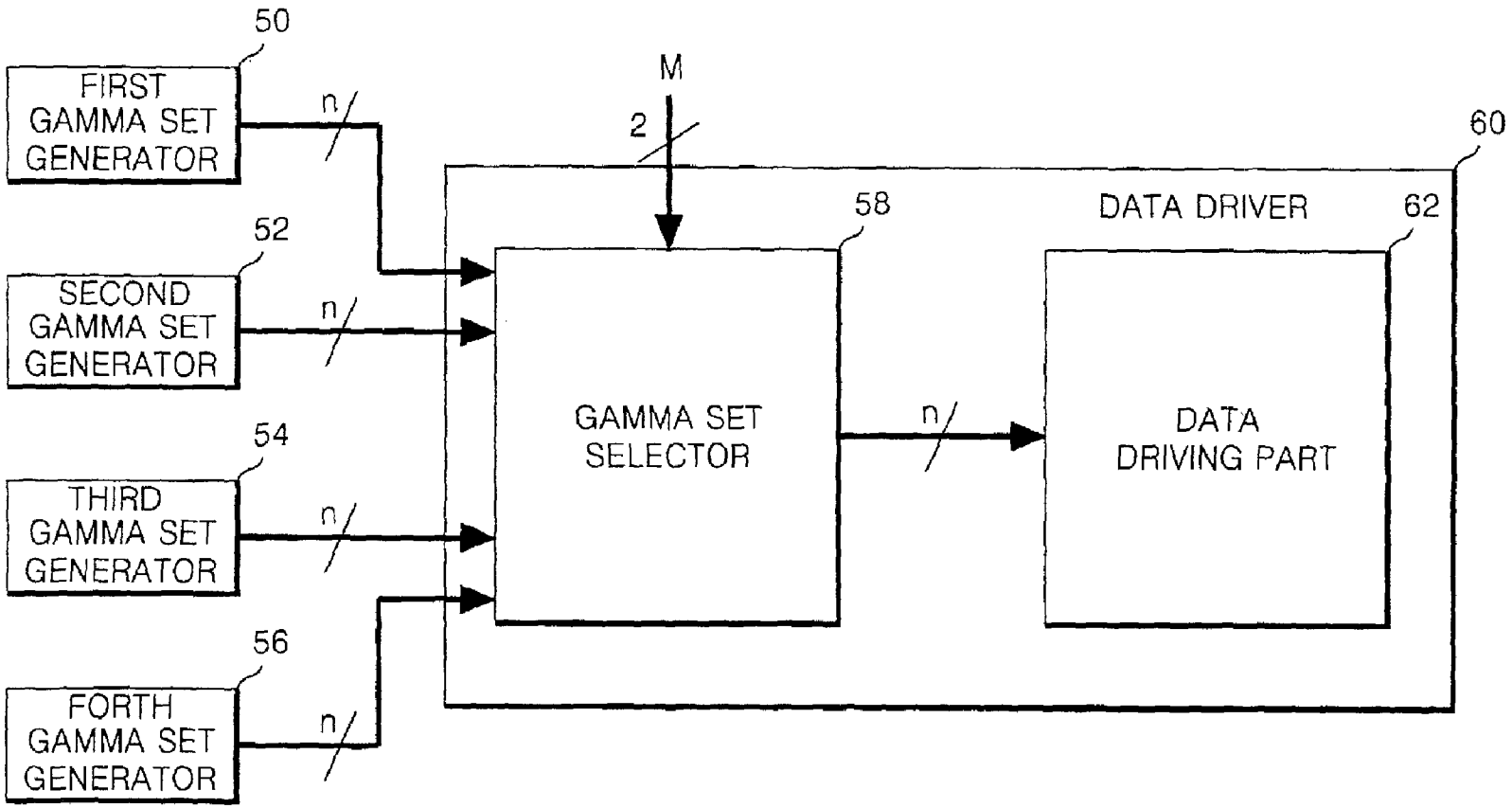
FIG. 5 is a diagram illustrating a gamma voltage generating apparatus according to a second exemplary embodiment of the present invention.

FIG. 5 illustrates a gamma voltage generating apparatus for an EL display device according to a second exemplary embodiment of the present invention.

The gamma voltage generating apparatus shown in FIG. 5, as compared with the gamma voltage generating apparatus shown in FIG. 4, includes similar components except that a gamma set selector 58 integrated into a data driver 60.

The four gamma set generators (i.e., the first to fourth gamma set generators 50, 52, 54, and 56 in the exemplary embodiment illustrated) generate the first to fourth gamma voltage sets different than one another corresponding to the brightness modes of the outside that are respectively different than one another. In this case, the first to fourth gamma voltage sets respectively generated from the first to fourth gamma set generator 50, 52, 54, and 56 correspond to brightness modes different than one another. Thus, each gamma voltage set includes gamma voltages with voltage levels different than one another. That is, the first to fourth gamma set generator 50, 52, 54, and 56 each generate different gamma voltages than one another for the same brightness level in accordance with a preset brightness mode.

To this end, the first to fourth gamma set generators 50, 52, 54, and 56 each include a plurality of resistors connected in series between a supply voltage source VDD and a ground voltage source GND similar to that shown in FIG. 3. The first to fourth gamma set generators 50, 52, 54, and 56 each further include resistors with different values than one another because the gamma voltage sets with different levels than one another are to be generated.

The gamma set selector 58 built in the data driver 60 selects any one gamma voltage set of the first to fourth gamma voltage sets from the first to fourth gamma set generators 50, 52, 54, and 56 in response to a brightness mode signal M input from the outside to apply the selected gamma voltage set to the data driving part 62. Herein, the brightness mode signal M is generated through a control block (not shown) when a user selects a brightness mode based on a brightness mode selection button provided in an EL display device or a computer system connected to the EL display device or a brightness mode selection menu displayed in the EL display panel. Further, the brightness mode signal M may be generated when the extent of the outside brightness is detected by a brightness detection sensor provided at the outside of the EL display device. In the example illustrated, such a brightness mode signal M includes two-bit data to control the brightness mode having four steps corresponding thereto in the case of there being the first to fourth gamma set generators 50, 52, 54, and 56 as shown in FIG. 5. The data driving part 62 in the data driver 60 converts a digital pixel data applied from a control block (not shown) into an analog pixel signal based on a gamma voltage set input through the gamma set selector 58, and applies the analog pixel signal to the data lines of an EL display panel (not shown).

On the other hand, each of R, G, and B fluorescent substances included in an EL cell has a different light-emitting efficiency. That is, when the data signals of the same level are applied to the R, G, and B cells, the brightness levels of the R, G, and B cells are different than each other. Accordingly, the gamma voltages for the same brightness should be set to be different for each of the R, G, and B cells to achieve proper the white balance of the R, G, and B cells. Accordingly, the gamma voltage generating apparatus generates a gamma voltage set established differently by R, G, and B. Further, the gamma voltage generating apparatus should generate different gamma voltage sets from each other for each of the R, G, and B cells in accordance with the brightness mode desired by a user. For instance, if the number of brightness mode is 3, the gamma voltage generating apparatus must generate a total of nine different gamma voltage sets, as shown in FIG. 6 as follows.

Figure 6:
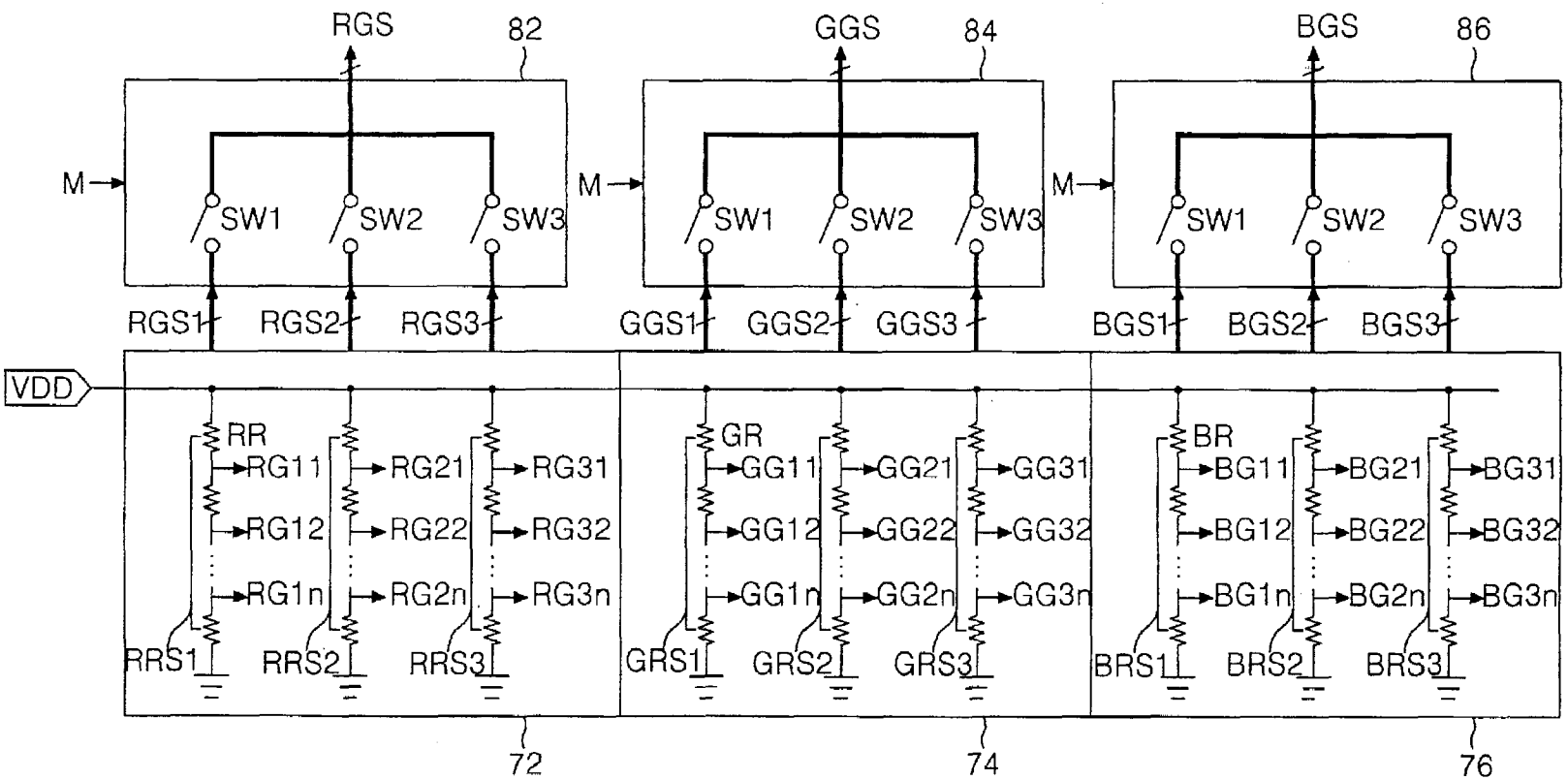
FIG. 6 is a diagram illustrating a gamma voltage generating apparatus according to a third exemplary embodiment of the present invention.

FIG. 6 illustrates a gamma voltage generating apparatus according to a third exemplary embodiment of the present invention.

A gamma voltage generating apparatus shown in FIG. 6 includes an R gamma voltage generator 72 generating three R gamma voltage sets RGS1, RGS2, RGS3, a G gamma voltage generator 74 generating three G gamma voltage sets GGS1, GGS2, GGS3, and a B gamma voltage generator 76 generating three B gamma voltage sets BGS1, BGS2, BGS3. The gamma voltage generating apparatus shown in FIG. 6 further includes first to third multiplexors 82, 84, 86 that select the gamma voltage sets of each of the R, G, and B gamma voltage generator 72, 74, and 76 in response to a brightness mode signal M to output the selected gamma voltage sets.

The R gamma voltage generator 72 generates first to third R gamma voltage sets RGS1, RGS2, RGS3 each corresponding to the different brightness modes. For this, the R gamma voltage generator 72 includes first to third R resistor sets RRS1 to RRS3 connected in parallel between the supply line of a supply voltage VDD and a ground voltage GND. Each of the first to third R resistor sets RRS1 to RRS3 includes (n+1) resistors RS connected in series between the supply line of the supply voltage VDD and the supply line of the ground voltage GND. Accordingly, the R gamma voltage generator 72 generates the first R gamma voltage set RGS1 including n R gamma voltages RG11 to RG1n generated in each of voltage division points of the first R resistor set RRS1, the second R gamma voltage set RGS2 including n R gamma voltages RG21 to RG2n generated in each of voltage division points of the second R resistor set RRS2, and the third R gamma voltage set RGS3 including n R gamma voltages RG31 to RG3n generated in each of voltage division points of the third R resistor set RRS3. Herein, the first to third R gamma voltage sets RGS1 to RGS3 each have different levels than each other by gamma voltage sets to correspond to different brightness modes than each other. The first multiplexor 82 includes first to third switch SW1 to SW3 responding to the brightness mode signal M from the outside, and selects any one R gamma voltage set among the first to third R gamma voltage sets RGS1 to RGS3 generated at the R gamma voltage generator 72 to output the selected R gamma voltage set.

The G gamma voltage generator 74 generates first to third G gamma voltage sets GGS1, GGS2, GGS3 each corresponding to the different brightness modes. For this, the G gamma voltage generator 74 includes first to third G resistor sets GRS1 to GRS3 connected in parallel between the supply line of a supply voltage VDD and a ground voltage GND. Each of the first to third G resistor sets GRS1 to GRS3 includes (n+1) resistors GS connected in series between the supply line of the supply voltage VDD and the supply line of the ground voltage GND. Accordingly, the G gamma voltage generator 74 generates the first G gamma voltage set GGS1 including n G gamma voltages GG11 to GG1n generated in each of voltage division points of the first G resistor set GRS1, the second G gamma voltage set GGS2 including of G gamma voltages GG21 to GG2n generated in each of voltage division points of the second G resistor set GRS2, and the third G gamma voltage set GGS3 including of G gamma voltages GG31 to GG3n generated in each of voltage division points of the third G resistor set GRS3. Herein, the first to third G gamma voltage sets GGS1 to GGS3 each have different levels than each other by gamma voltage sets to correspond to different brightness modes than from each other. The second multiplexor 84 includes first to third switch SW1 to SW3 responding to the brightness mode signal M, and selects any one G gamma voltage set among the first to third G gamma voltage sets GGS1 to GGS3 generated at the G gamma voltage generator 74 to output the selected G gamma voltage set.

The B gamma voltage generator 76 generates first to third B gamma voltage sets BGS1, BGS2, BGS3 each corresponding to the different brightness modes. For this, the B gamma voltage generator 76 includes first to third B resistor sets BRS1 to BRS3 connected in parallel between the supply line of a supply voltage VDD and the supply line of a ground voltage GND. Each of the first to third B resistor sets BRS1 to BRS3 includes (n+1) resistors BS connected in series between the supply line of the supply voltage VDD and the supply line of the ground voltage GND. Accordingly, the B gamma voltage generator 76 generates the first B gamma voltage set BGS1 including n B gamma voltages BG11 to BG1n generated in each of voltage division points of the first B resistor set BRS1, the second B gamma voltage set BGS2 including n B gamma voltages BG21 to BG2n generated in each of voltage division points of the second B resistor set BRS2, and the third B gamma voltage set BGS3 including n B gamma voltages BG31 to BG3n generated in each of voltage division points of the third B resistor set BRS3. Herein, the first to third B gamma voltage sets BGS1 to BGS3 each have different levels than each other by gamma voltage sets to correspond to different brightness modes than each other. The third multiplexor 86 includes first to third switch SW1 to SW3 responding to the brightness mode signal M, and selects any one B gamma voltage set among the first to third B gamma voltage sets BGS1 to BGS3 generated at the B gamma voltage generator 76 to output the selected B gamma voltage set.

In this way, the gamma voltage generating apparatus shown in FIG. 6 generates the R, G and B gamma voltage sets RGS, GGS and BGS corresponding to one brightness mode and applied the generated gamma voltage set to a data driver (not shown). Accordingly, the data driver (not shown) converts a digital pixel data from a control block (not shown) into an analog pixel signal based on the R, G and B gamma voltage sets RGS, GGS, and BGS input from the gamma voltage generating apparatus. The analog pixel signal is then applied to the data lines of an EL display panel (not shown). Herein, the first to third multiplexors 82, 84 and 86 can be built in the data driver (not shown) to be realized.

Figure 7:
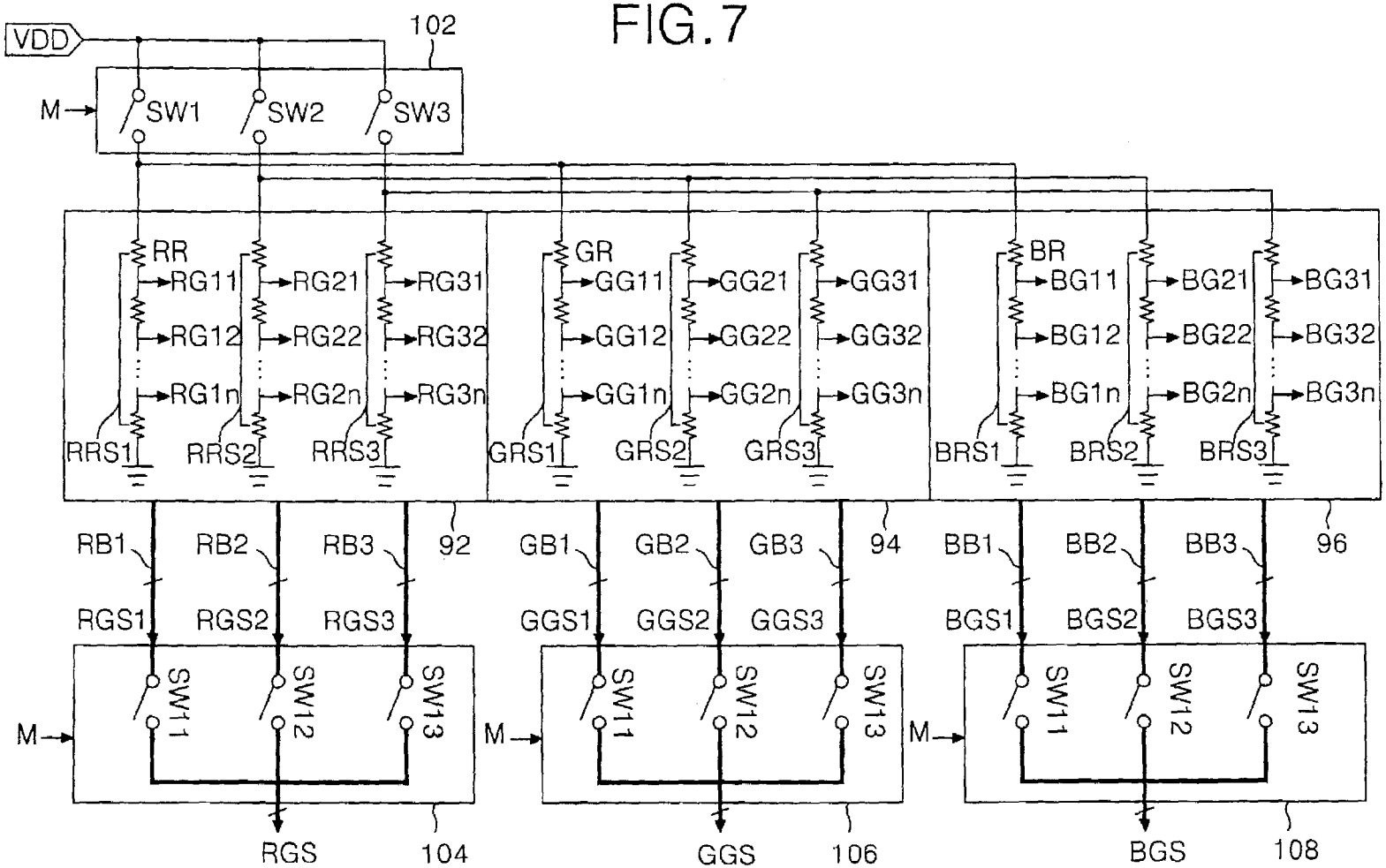
FIG. 7 is a diagram illustrating a gamma voltage generating apparatus according to a fourth exemplary embodiment of the present invention.

FIG. 7 illustrates a gamma voltage-generating apparatus according to the fourth exemplary embodiment of the present invention.

Referring to FIG. 7, the gamma voltage-generating apparatus includes an R gamma voltage generator 92 generating three R gamma voltage sets RGS1 to RGS3, a G gamma voltage generator 94 generating three G gamma voltage sets GGS1 to GGS3, a B gamma voltage generator 96 generating three B gamma voltage sets BGS1 to BGS3, a first multiplexor 102 applying a supply voltage VDD to each of the R, G, and B gamma voltage generators 92, 94, and 96 in accordance with a brightness mode signal M. And, the gamma voltage generating apparatus, shown in FIG. 7, further includes second to fourth multiplexors 104, 106 and 108 selectively outputting only the gamma voltage set necessary at each of the R, G and B gamma set generators 92, 94 and 96 in accordance with the brightness mode signal M.

The first multiplexor 102—including first to third switches SW1 to SW3—selectively applies the supply voltage VDD to a resistor set divided by modes in each of the R, G, and B gamma voltage generator 92, 94 and 96 in response to the brightness mode signal M from the outside.

The R gamma voltage generator 92 generates any one of first to third R voltage sets RGS1 to RGS3 in response to different brightness modes from each other. To this end, the R gamma voltage generator 92 includes first to third R resistor set RRS1 to RRS3 that are commonly connected to a ground voltage GND and selectively connected to the supply line of a supply voltage VDD through the first multiplexor 102. Each of the first to third R resistor sets RRS1 to RRS3 consists of (n+1) resistors RS connected in series between the supply line of the supply voltage VDD, which is selectively connected through the first multiplexor 102, and the ground voltage GND. Accordingly, the R gamma voltage generator 92 generates the first R gamma voltage set RGS1 including a total of n R gamma voltages RG11 to RG1n through each of voltage division points of the first R resistor set RRS1 and outputs the generated first R gamma voltage set RGS1 through a first output bus RB1 when the supply voltage VDD is applied to the first R resistor set RRS1 through the first multiplexor 102. Further, the R gamma voltage generator 92 generates the second R gamma voltage set RGS2 including a total of n R gamma voltages RG21 to RG2n through each of voltage division points of the second R resistor set RRS2 when the supply voltage VDD is applied to the second R resistor set RRS2 through the first multiplexor 102 and outputs the generated second R gamma voltage set RGS2 through a second output bus RB2. In addition, the R gamma voltage generator 92 generates the third R gamma voltage set RGS3 including a total of n R gamma voltages RG31 to RG3n through each of voltage division points of the third R resistor set RRS3 when the supply voltage VDD is applied to the third R resistor set RRS3 through the first multiplexor 102. Each of the first to third R gamma voltage sets RGS1 to RGS3 selectively output from such an R gamma voltage generator 92 has a different level than the other gamma voltage sets because the first to third R gamma voltage set RGS1 to RGS3 correspond to different brightness modes.

On the other hand, except for one R resistor set supplied with the supply voltage VDD among the first to third R resistor sets RRS1 to RRS3, the remaining two R resistor sets become in a floating state. Accordingly, the one R resistor set outputs a normal R gamma voltage set through its output bus, while the remaining two R resistor sets output unnecessary voltage through their output bus. For instance, the normal first R gamma voltage set RGS1 is output at its first output bus RB1 when the supply voltage VDD is applied to the first R resistor set RRS1, while unnecessary voltage is output at the second and third output buses RB2 and RB3 of the second and third R resistor sets RRS2 and RRS3. In order to prevent such unnecessary voltage from being applied to the data driver, the second multiplexor 104 includes first to third switches SW11 to SW13 responding to the brightness mode signal M and selects only a normal R gamma voltage set RGS to output the selected R gamma voltage set RGS.

The G gamma voltage generator 94 generates any one of first to third G voltage set GGS1 to GGS3 in response to different brightness modes from each other. To this end, the G gamma voltage generator 94 includes first to third G resistor set GRS1 to GRS3 that are commonly connected to a ground voltage GND and selectively connected to the supply line of a supply voltage VDD through the first multiplexor 102. Each of the first to third G resistor sets GRS1 to GRS3 consists of (n+1) resistors GS connected in series between the supply line of the supply voltage VDD, which is selectively connected through the first multiplexor 102, and the ground voltage GND. Accordingly, the G gamma voltage generator 94 generates the first G gamma voltage set GGS1 including a total of n G gamma voltages GG11 to GG1n through each of voltage division points of the first G resistor set GRS1 and outputs the generated first G gamma voltage set GGS1 trough a first output bus GB1 when the supply voltage VDD is applied to the first G resistor set GRS1 through the first multiplexor 102. Further, the G gamma voltage generator 94 generates the second G gamma voltage set GGS2 including a total of n G gamma voltages GG21 to GG2n through each of voltage division points of the second G resistor set GRS2 when the supply voltage VDD is applied to the second G resistor set GRS2 through the first multiplexor 102 and outputs the generated second G gamma voltage set GGS2 through a second output bus GB2. In addition, the G gamma voltage generator 94 generates the third G gamma voltage set GGS3 including a total of n G gamma voltages GG31 to GG3n through each of voltage division points of the third G resistor set GRS3 when the supply voltage VDD is applied to the third G resistor set GRS3 through the first multiplexor 102. Each of the first to third G gamma voltage sets GGS1 to GGS3 selectively output from such an G gamma voltage generator 94 has a different level than the other gamma voltage sets because the first to third G gamma voltage set correspond to different brightness modes.

On the other hand, except for one G resistor set supplied with the supply voltage VDD among the first to third G resistor sets GRS1 to GRS3, the remaining two G resistor sets become in a floating state. Accordingly, the one G resistor set outputs a normal G gamma voltage set through its output bus, while the remaining two G resistor sets output unnecessary voltage through their output bus. For instance, the normal first G gamma voltage set GGS1 is output at its first output bus GB1 when the supply voltage VDD is applied to the first G resistor set GRS1, while unnecessary voltage is output at the second and third output buses GB2 and GB3 of the second and third G resistor sets GRS2 and GRS3. In order to prevent such unnecessary voltage from being applied to the data driver, the third multiplexor 106 includes first to third switches SW11 to SW13 responding to the brightness mode signal M and selects only a normal G gamma voltage set GGS to output the selected G gamma voltage set GGS.

The B gamma voltage generator 96 generates any one of first to third B voltage sets BGS1 to BGS3 in response to different brightness modes from each other. To this end, the B gamma voltage generator 96 includes first to third B resistor set BRS1 to BRS3 that are commonly connected to a ground voltage GND and selectively connected to the supply line of a supply voltage VDD through the first multiplexor 102. Each of the first to third B resistor sets BRS1 to BRS3 consists of (n+1) resistors BS connected in series between the supply line of the supply voltage VDD, which is selectively connected through the first multiplexor 102, and the ground voltage GND. Accordingly, the B gamma voltage generator 96 generates the first B gamma voltage set BGS1 including a total of n B gamma voltages BG11 to BG1n through each of voltage division points of the first B resistor set BRS1 and outputs the generated first B gamma voltage set BGS1 through a first output bus BB1 when the supply voltage VDD is applied to the first B resistor set BRS1 through the first multiplexor 102. Further, the B gamma voltage generator 96 generates the second B gamma voltage set BGS2 including a total of n B gamma voltages BG21 to BG2n through each of voltage division points of the second B resistor set BRS2 when the supply voltage VDD is applied to the second B resistor set BRS2 through the first multiplexor 102 and outputs the generated second B gamma voltage set BGS2 through a second output bus BB2. In addition, the B gamma voltage generator 96 generates the third B gamma voltage set BGS3 including a total of n B gamma voltages BG31 to BG3n through each of voltage division points of the third B resistor set BRS3 when the supply voltage VDD is applied to the third B resistor set BRS3 through the first multiplexor 102. Each of the first to third B gamma voltage sets BGS1 to BGS3 selectively output from such an B gamma voltage generator 96 has a different level than the other gamma voltage sets because the first to third B gamma voltage set BGS1 to BGS3 correspond to different brightness modes.

On the other hand, except for one B resistor set supplied with the supply voltage VDD among the first to third B resistor sets BRS1 to BRS3, the remaining two B resistor sets become in a floating state. Accordingly, the one B resistor set outputs a normal B gamma voltage set through its output bus, while the remaining two B resistor sets output unnecessary voltage through their output bus. For instance, the normal first B gamma voltage set BGS1 is output at its first output bus BB1 when the supply voltage VDD is applied to the first B resistor set BRS1, while unnecessary voltage is output at the second and third output buses BB2 and BB3 of the second and third B resistor sets BRS2 and BRS3. In order to prevent such unnecessary voltage from being applied to the data driver, the fourth multiplexor 108 includes first to third switches SW11 to SW13 responding to the brightness mode signal M and selects only a normal B gamma voltage set BGS to output the selected B gamma voltage set BGS.

Figure 8:
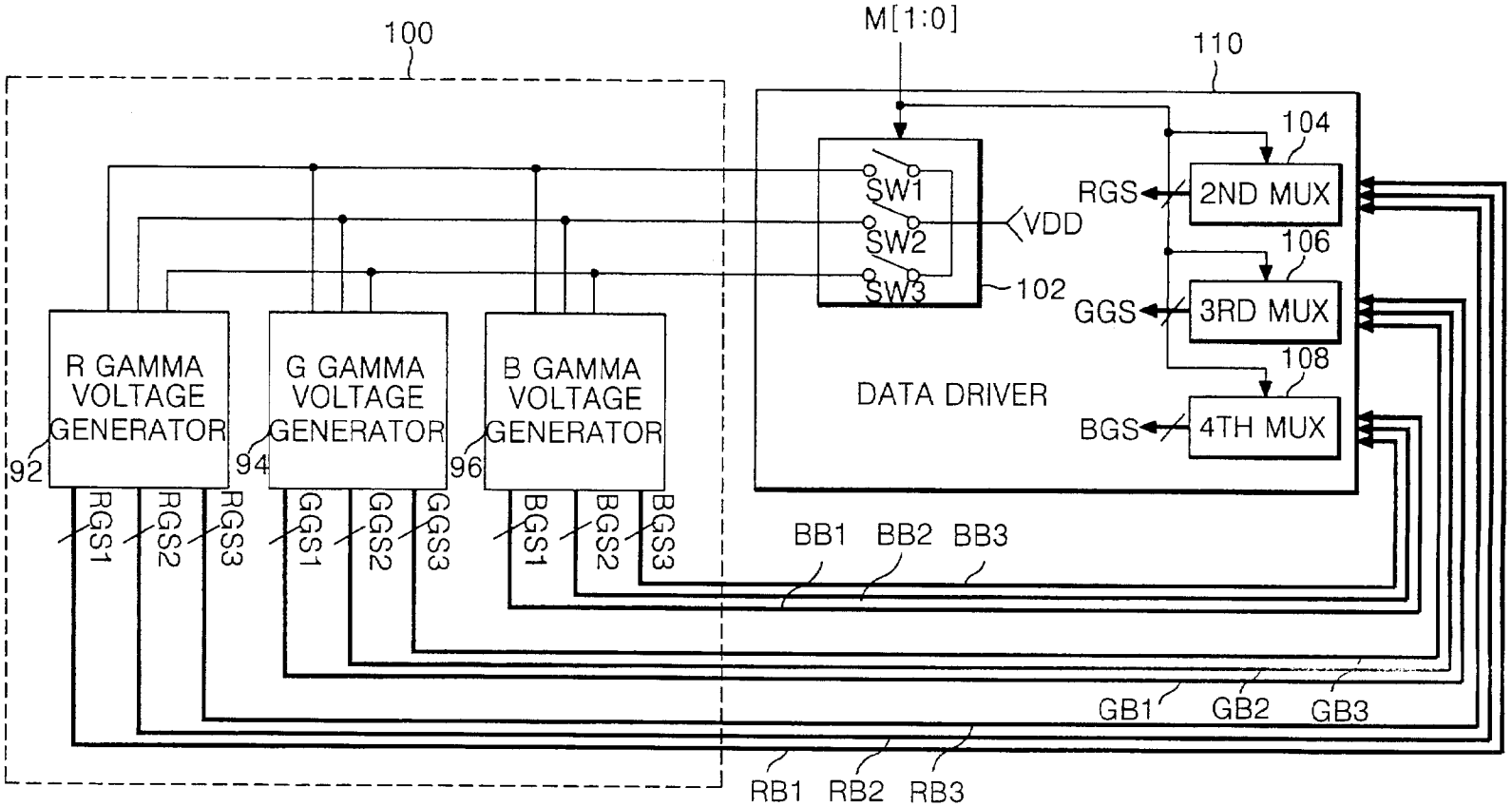
FIG. 8 is a diagram illustrating a first configuration to realize the gamma voltage generating apparatus shown in FIG. 7.

Like this, the gamma voltage-generating apparatus, shown in FIG. 7, according to the present invention selectively applies the supply voltage VDD to the resistor sets divided by modes in each of the R, G, and B gamma voltage generator 92, 94, and 96 through the first multiplexor 102 in response to the brightness mode signal M. Accordingly, the gamma voltage-generating apparatus according to the present invention, as shown in FIG. 7, applies the supply voltage VDD only to the resistor set of a selected mode through the first multiplexor 102 and does not apply the supply voltage VDD to the resistor set of unused modes. As a result, power can be prevented from being dissipated unnecessarily. For example, in the event that each of the R, G, and B gamma voltage generators 92, 94 and 96 includes three resistor sets as shown in FIG. 8, the supply voltage VDD is applied only to the three resistor sets in accordance with the brightness mode signal M and is not applied to the remaining six resistor sets. Consequently, unnecessary power waste caused by the remaining six resistor sets is prevented. Further, the gamma voltage generating apparatus, shown in FIG. 7, can prevent the unnecessary voltage generated at the remaining six resistor sets from being applied to the data driver through the second to fourth multiplexors 104, 106 and 108 which are each connected to each output terminal of the R, G and B gamma voltage generators 92, 94 and 96.

The gamma voltage-generating apparatus according to the present invention can be realized in four forms as shown in FIGS. 8 to 11.

Referring to FIG. 8, the first to fourth multiplexors 102 to 108 in the gamma voltage-generating apparatus is built in a data driver 110, and the gamma voltage generator 100 including the R, G and B gamma voltage generators 92, 94, 96 is realized separately from the data driver 110. The first multiplexor 102 included in the data driver 110 and including the first and third switch SW1 to SW3 applies the supply voltage VDD to the R, G and B gamma voltage generators 92, 94, and 96 in accordance with the brightness mode signal M from a control block (not shown). Herein, the brightness mode signal M is made up of two-bit data, for example, representing three modes. Accordingly, each of the R, G, and B gamma voltage generators 92, 94 and 96, as described above, generates the R, G, and B gamma voltage set RGS, GGS, and BGS of a corresponding mode through the resistor set selected by the first multiplexor 102 (i.e., the resistor set to which the supply voltage VDD is applied) and outputs the R, G and B gamma voltage set of the corresponding mode to the data driver 110 through the corresponding output bus. In this case, the unnecessary voltage is output through the other output buses connected between the data driver 110 and the R, G and B gamma voltage generators 92, 94 and 96.

Each of the second to fourth multiplexors 104 to 108 selects only the normal R, G and B gamma voltage sets RGS, GGS and BGS among the voltages supplied through the output buses RB1 to RB3, GB1 to GB3, BB1 to BB3 of the R, G and B gamma voltage generators 92, 94 and 96 in accordance with the brightness mode signal M and applies the selected gamma voltage sets to a data driving part of the data driver 110.

The data driver 110 converts digital pixel data applied from the control block into an analog pixel signal. The analog pixel signal is then applied to the data lines of an EL display panel (not shown) based on the R, G, and B gamma voltage set RGS, GGS, and BGS applied from the second to fourth multiplexors 104, 106 and 108 in accordance with the brightness mode signal.

Figure 9:
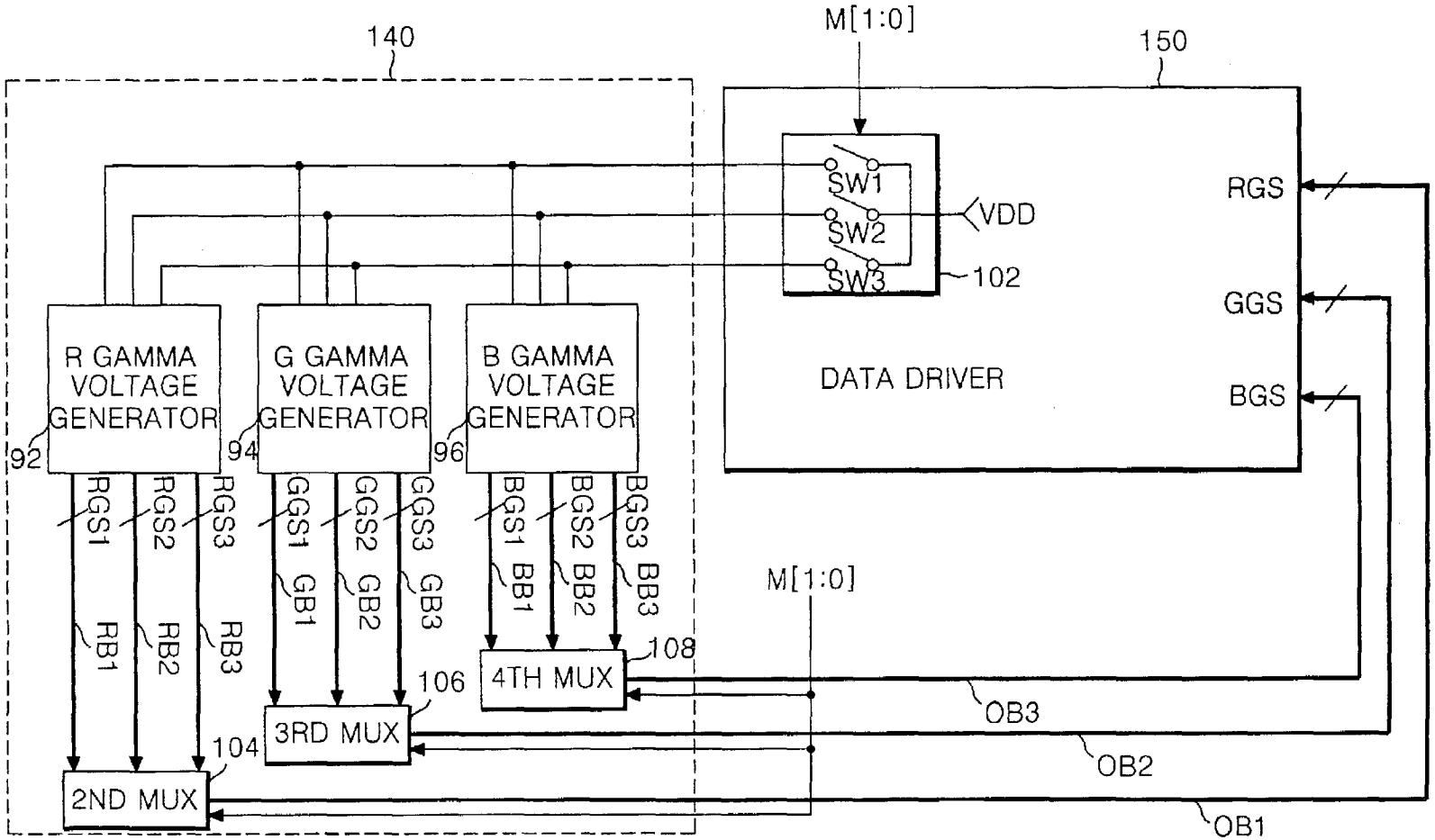
FIG. 9 is a diagram illustrating a second configuration to realize the gamma voltage generating apparatus shown in FIG. 7.

Referring to FIG. 9, the first multiplexor 102 is integrated in a data driver 150. A gamma voltage generator 140 including the R, G, and B gamma voltage generators 92, 94 and 96, and the second to fourth multiplexors 104, 106 and 108 is realized separately from the data driver 150. Herein, since the function and operation of each of the components is the same as described above, it will be omitted.

In this way, when the second to fourth multiplexors 104, 106 and 108 are integrated together with the R, G and B gamma voltage generators 92, 94 and 96, the gamma voltage generator 140 outputs only the normal R, G and B gamma voltage sets RGS, GGS and BGS selected to the data driver 150 in accordance with the brightness mode signal M. Accordingly, the number of the output buses OB1, OB2 and OB3 of the gamma voltage generator 140 shown in FIG. 9 can be reduced more as compared with the gamma voltage generating apparatus 100 shown in FIG. 8.

Figure 10:
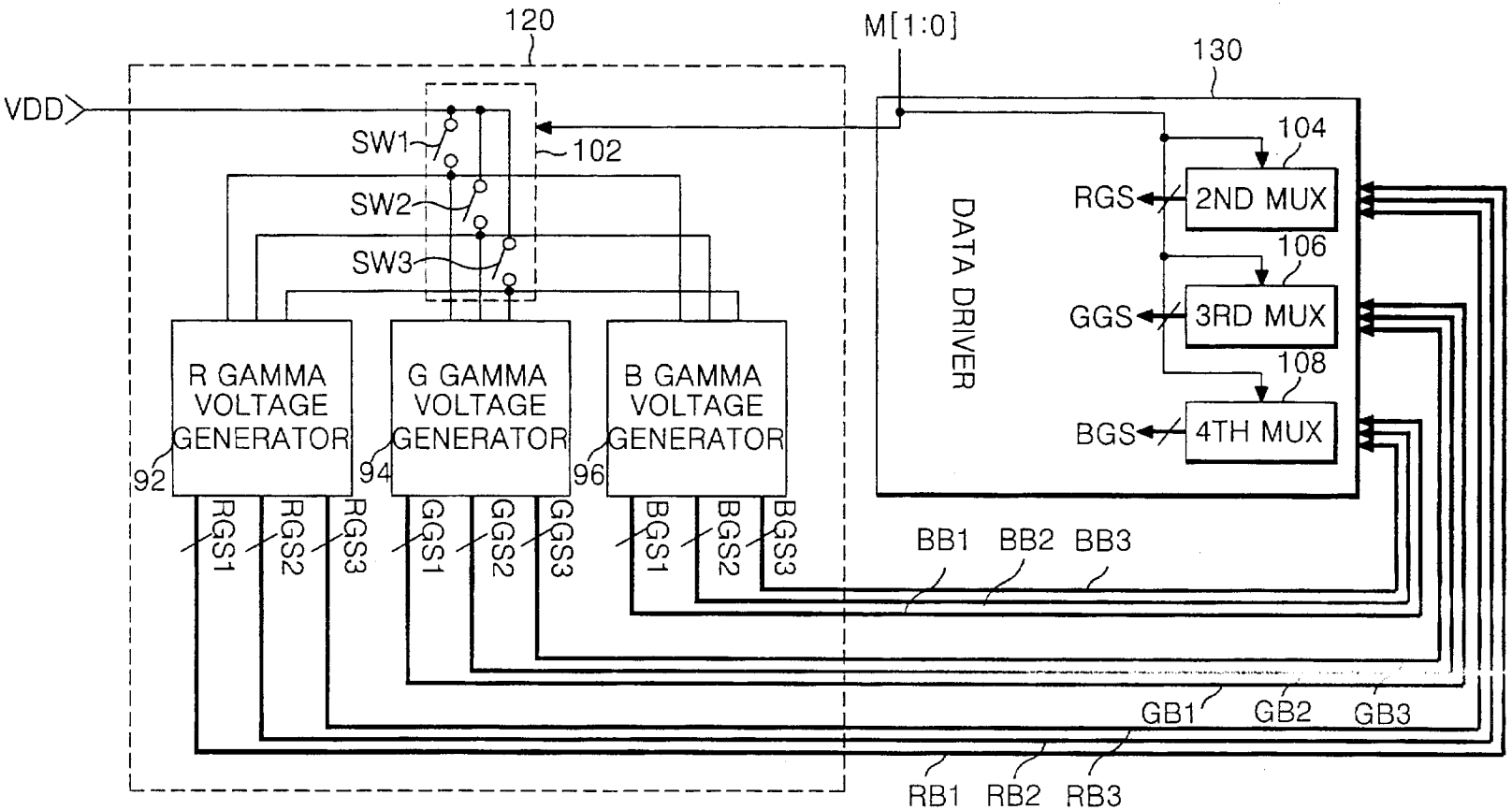
FIG. 10 is a diagram illustrating a third configuration to realize the gamma voltage generating apparatus shown in FIG. 7.

Referring to FIG. 10, the second to fourth multiplexors 104, 106 and 108 are integrated in a data driver 130. A gamma voltage generator 120 including the R, G, and B gamma voltage generators 92, 94 and 96, and the first multiplexor 102 is realized separately from the data driver 130. Herein, since the function and operation of each of the components is the same as described above, it will be omitted.

Figure 11:
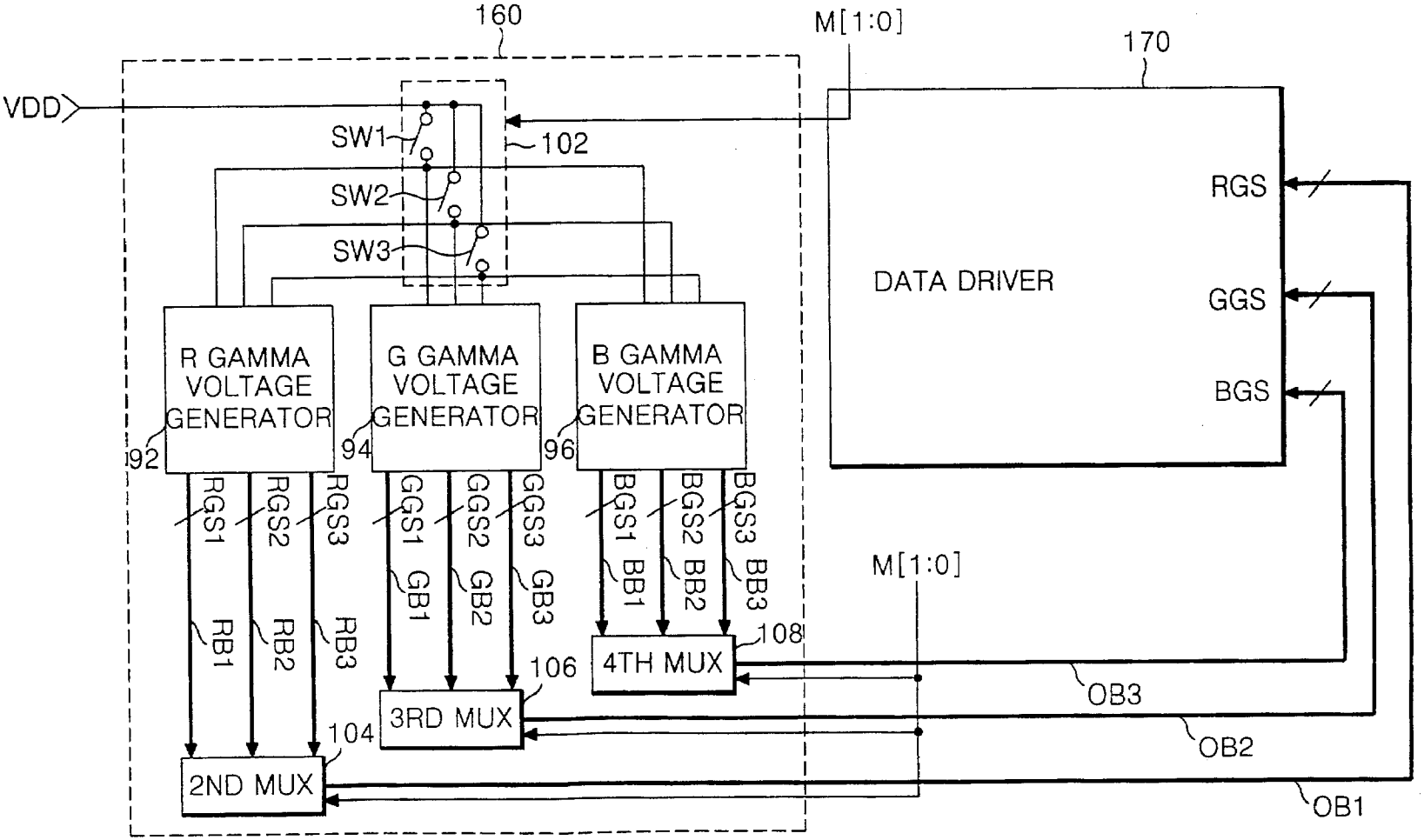
FIG. 11 is a diagram illustrating a fourth configuration to realize the gamma voltage generating apparatus shown in FIG. 7.

Referring to FIG. 11, a gamma voltage generator 160 includes the R, G, and B gamma voltage generators 92, 94, 96 and the first to fourth multiplexors 102 to 108, and is realized separately from the data driver 170. Herein, since the function and operation of each of the components are the same as described above, it will be omitted. And, the brightness mode signal M, as in FIG. 11, is applied to the gamma voltage generator 160 from the external control block directly or through the data driver 170.

As described above, the method and apparatus for generating gamma voltage according to the present invention selects any one gamma voltage set of a plurality of gamma voltage sets in accordance with the brightness mode and apply the selected gamma voltage set to the data driver, so that the display device can be made to provide a best picture quality without regard to the extent of the outside brightness. The gamma voltage-generating apparatus according to the present invention selectively applies the supply voltage to each of the resistor sets divided by modes in the R, G and B gamma voltage generator in accordance with the brightness mode. Therefore, the gamma voltage-generating apparatus according to the present invention applies the supply voltage only to the resistor set corresponding to the selected mode and does not apply the supply voltage VDD to the resistor set corresponding to unused modes, thereby preventing unnecessary power dissipation.

It will be apparent to those skilled in the art that various modifications and variations can be made in the apparatus and method of generating gamma voltage of the present invention without departing from the spirit or scope of the invention. Thus, it is intended that the present invention cover the modifications and variations of this invention provided they come within the scope of the appended claims and their equivalents.

What is claimed is:

1. An apparatus for generating gamma voltage, comprising:

a plurality of gamma set generators to generate a plurality of gamma voltage sets that include gamma voltages having different voltage levels from each other, each gamma voltage set corresponding with a respective brightness mode corresponding to a brightness of an operational environment, wherein the plurality of gamma set generators includes a red gamma voltage generator to generate a plurality of red gamma voltage sets, a green gamma voltage generator to generate a plurality of green gamma voltage sets, and a blue gamma voltage generator to generate a plurality of blue gamma voltage sets; and a gamma set selector to select any one of the gamma voltage sets in response to the brightness mode and to drive data lines of a display device in accordance with the selected gamma voltage set wherein the gamma set selector includes a first multiplexor to select one of the red gamma voltage sets in accordance with the brightness mode to output the selected red gamma voltage set, a second multiplexor to select one of the green gamma voltage sets in accordance with the brightness mode to output the selected green gamma voltage set, and a third multiplexor to select one of the blue gamma voltage sets in accordance with the brightness mode to output the selected blue gamma voltage set.

2. The apparatus according to claim 1, wherein each of the gamma set generators includes a plurality of resistors connected in series between a supply voltage and a ground voltage, the gamma set generators generating the different gamma voltage levels through division points between the resistors.

3. The apparatus according to claim 2, wherein the resistors have different resistance values from each other.

4. The apparatus according to claim 1, wherein the gamma set selector and a data driver are formed in an integrated circuit.

5. An apparatus for generating gamma voltage, comprising:

a multiplexor to selectively apply a supply voltage in response to a brightness mode corresponding to a brightness of an operational environment;

a gamma voltage generator having a plurality of gamma voltage set generators to generate a plurality of gamma voltage sets that include gamma voltages having different voltage levels from each other such that each gamma voltage corresponds to a respective brightness mode, the gamma voltage generator generating a gamma voltage set at a corresponding gamma voltage set generator to which the supply voltage is selectively applied by the multiplexor and applying the generated gamma voltage set, wherein the plurality of gamma set generators includes a red gamma voltage generator to generate a plurality of red gamma voltage sets, a green gamma voltage generator to generate a plurality of green gamma Voltage sets, and a blue gamma voltage generator to generate a plurality of blue gamma voltage sets; and a gamma set selector to select any one of the gamma voltage sets in response to the brightness mode and to drive data lines of a display device in accordance with the selected gamma voltage set wherein the gamma set selector includes a first multiplexor to select one of the red gamma voltage sets in accordance with the brightness mode to output the selected red gamma voltage set, a second multiplexor to select one of the green gamma voltage sets in accordance with the brightness mode to output the selected green gamma voltage set, and a third multiplexor to select one of the blue gamma voltage sets in accordance with the brightness mode to output the selected blue gamma voltage set.

6. The apparatus according to claim 5, wherein each of the red, green, and blue gamma voltage generators has a plurality of gamma voltage set generators to provide respective gamma voltages representing the brightness mode.

7. The apparatus according to claim 6, wherein each of the red, green, and blue gamma voltage generators generates and applies the gamma voltage set of the corresponding brightness mode at the gamma voltage set generator to which the supply voltage is applied through the multiplexor.

8. The apparatus according to claim 6, wherein each of the gamma voltage set generators includes a plurality of resistors connected in series between a supply line that provides the supply voltage through the multiplexor and a ground voltage.

9. The apparatus according to claim 5, wherein the multiplexor is included in a data driver that converts a digital pixel data signal into an analog pixel signal based on the gamma voltage set from the gamma voltage generator.

10. The apparatus according to claim 5, wherein a brightness mode signal is applied from an outside controller through a data driver that converts a digital pixel data signal into an analog pixel signal based on the gamma voltage set from the gamma voltage generator.

11. The apparatus according to claim 5, wherein the gamma set selector and a data driver are formed in an integrated circuit.

12. A method for generating gamma voltage, comprising the steps of:

generating a plurality of gamma voltage sets including gamma voltages with different voltage levels from each other in accordance with preset brightness modes each corresponding to a brightness of an operational environment using a plurality of gamma set generators that includes a red gamma voltage generator to generate a plurality of red gamma voltage sets, a green gamma voltage generator to generate a plurality of green gamma voltage sets, and a blue gamma voltage generator to generate a plurality of blue gamma voltage sets;

generating a brightness mode signal in accordance with an external brightness mode; and selecting and applying one of the gamma voltage sets having one of the preset brightness modes corresponding to the brightness mode signal using a gamma set selector that includes a first multiplexor to select one of the red gamma voltage sets in accordance with the brightness mode to output the selected red gamma voltage set, a second multiplexor to select one of the green gamma voltage sets in accordance with the brightness mode to output the selected green gamma voltage set, and a third multiplexor to select one of the blue gamma voltage sets in accordance with the brightness mode to output the selected blue gamma voltage set.

13. A method for generating gamma voltage, comprising the steps of:

selectively applying a supply voltage in response to a brightness mode signal corresponding to a brightness of an operational environment;

generating a gamma voltage set of a corresponding brightness mode at the gamma voltage set generator to which the supply voltage is applied among a plurality of gamma voltage set generators for generating a plurality of gamma voltage sets that include gamma voltages having different voltage levels from each other in accordance with the brightness mode using a plurality of gamma set generators that includes a red gamma voltage generator to generate a plurality of red gamma voltage sets, a green gamma voltage generator to generate a plurality of green gamma voltage sets, and a blue gamma voltage generator to generate a plurality of blue gamma voltage sets; and applying the generated gamma voltage set using a gamma set selector that includes a first multiplexor to select one of the red gamma voltage sets in accordance with the brightness mode to output the selected red gamma voltage set, a second multiplexor to select one of the green gamma voltage sets in accordance with the brightness mode to output the selected green gamma voltage set, and a third multiplexor to select one of the blue gamma voltage sets in accordance with the brightness mode to output the selected blue gamma voltage set.

14. The method according to claim 13, wherein the step of generating the gamma voltage set of the corresponding brightness mode includes:

generating a red gamma voltage set corresponding to the brightness mode at the red gamma voltage set generator to which the supply voltage is selectively applied among the plurality of red gamma voltage set generators for generating the plurality of red gamma voltage sets;

generating a green gamma voltage set corresponding to the brightness mode at the green gamma voltage set generator to which the supply voltage selectively applied among the plurality of green gamma voltage set generators for generating the plurality of green gamma voltage sets; and generating a blue gamma voltage set corresponding to the brightness mode at the blue gamma voltage set generator to which the supply voltage is selectively applied among the plurality of blue gamma voltage set generators for generating the plurality of blue gamma voltage sets.

15. The method according to claim 13, wherein the gamma voltage set is generated by dividing the supply voltage into a plurality of voltages by a plurality of resistors connected in series between a supply line having the supply voltage and a ground voltage.

* * * * *